US012404072B2

(12) United States Patent
Harris et al.

(10) Patent No.: US 12,404,072 B2
(45) Date of Patent: Sep. 2, 2025

(54) DUAL CONTAINER DRINKING VESSEL WITH UNIVERSAL LID

(71) Applicant: Base Brands, LLC, Atlanta, GA (US)

(72) Inventors: Jamison Corey Harris, Brookhaven, GA (US); Patrick Spivey, Atlanta, GA (US); Kenneth Kreafle, Atlanta, GA (US)

(73) Assignee: Base Brands, LLC, Atlanta, GA (US)

( * ) Notice: Subject to any disclaimer, the term of this patent is extended or adjusted under 35 U.S.C. 154(b) by 0 days.

(21) Appl. No.: 17/834,595

(22) Filed: Jun. 7, 2022

(65) Prior Publication Data

US 2023/0391503 A1 Dec. 7, 2023

(51) Int. Cl.

| | |
|---|---|
| ***B65D 21/02*** | (2006.01) |
| ***A47G 19/22*** | (2006.01) |
| ***A47G 19/23*** | (2006.01) |
| ***B65D 51/24*** | (2006.01) |
| ***B65D 81/38*** | (2006.01) |

(52) U.S. Cl.

CPC ..... *B65D 21/0233* (2013.01); *A47G 19/2272* (2013.01); *A47G 19/2288* (2013.01); *A47G 19/23* (2013.01); *B65D 51/24* (2013.01); *B65D 81/3865* (2013.01); *B65D 2231/022* (2013.01); *B65D 2543/00833* (2013.01)

(58) Field of Classification Search

CPC ..... B65D 21/0233; B65D 2543/00046; B65D 81/3205; B65D 81/3211; B65D 81/3222; B65D 21/0238; B65D 2231/022; B65D 2543/00833; B65D 43/0229; B65D 71/502; A47G 19/2205; A47G 19/2272

USPC ..... 206/499, 219; 215/10, 388, 6, DIG. 8, 215/900

See application file for complete search history.

(56) References Cited

U.S. PATENT DOCUMENTS

| | | | | | |
|---|---|---|---|---|---|
| 1,680,882 | A * | 8/1928 | Hollen | B65D 25/16 | 220/917 |
| 2,483,168 | A * | 9/1949 | Amberg | A47G 23/0216 | 220/737 |
| 4,530,442 | A * | 7/1985 | Vogel, Jr. | B65D 43/0216 | 220/DIG. 25 |
| 5,067,328 | A * | 11/1991 | Medina | B65D 81/3883 | 62/457.2 |
| 5,180,079 | A * | 1/1993 | Jeng | A47G 19/065 | 220/709 |
| 5,988,190 | A * | 11/1999 | Borges | B08B 3/044 | 134/135 |
| 6,706,297 | B1 * | 3/2004 | Toth | A47G 19/065 | 206/541 |
| 6,814,990 | B2 * | 11/2004 | Zeng | A47G 19/2205 | 206/217 |

(Continued)

*Primary Examiner* — Steven A. Reynolds
*Assistant Examiner* — Prince Pal
(74) *Attorney, Agent, or Firm* — Park, Vaughan, Fleming & Dowler LLP

(57) ABSTRACT

Described herein are embodiments of a dual container drinking vessel with a universal lid. In one embodiment, the apparatus includes a first vessel and a second vessel, where the first vessel and the second vessel are at least partially nested together, and further includes a lid adapted to cover an open end of the first vessel when the first vessel and the second vessel are at least partially nested together, and to cover an open end of the second vessel when the first vessel and the second vessel are not nested together.

26 Claims, 20 Drawing Sheets

(56) References Cited

U.S. PATENT DOCUMENTS 7,217,434 B1 * 5/2007 Loh ..... B65D 81/3205 206/217
D608,147 S * 1/2010 Sykes ..... D7/510
8,061,545 B2 * 11/2011 Roth ..... B65D 81/3205 206/217
8,147,120 B2 * 4/2012 Renna ..... A47J 43/27 215/DIG. 8
8,870,010 B2 * 10/2014 Buck ..... B65G 51/28 206/217
D723,871 S * 3/2015 Khubani ..... D7/505
9,289,005 B1 * 3/2016 Martin ..... A23G 9/221
D755,013 S * 5/2016 Khubani ..... D7/507
D767,335 S * 9/2016 Khubani ..... D7/507
9,452,876 B2 * 9/2016 Anelevitz ..... B65D 81/383
9,463,913 B2 * 10/2016 Strominger ..... A47G 19/065
9,545,607 B1 * 1/2017 Thompson ..... B01F 35/32021
D784,081 S * 4/2017 Szymanski ..... D7/510
9,915,472 B2 * 3/2018 Sabo ..... F25D 31/007
10,021,956 B2 * 7/2018 Clark ..... A45F 3/18
10,549,902 B1 * 2/2020 Brown, II ..... B65D 43/022
10,577,153 B2 * 3/2020 Ayeni ..... B65D 1/165
10,631,675 B1 * 4/2020 Ellsworth ..... B65D 51/24
10,849,445 B2 * 12/2020 Anthony ..... B65D 25/04
10,913,647 B2 * 2/2021 Lyons ..... B65D 81/3227
10,945,517 B1 * 3/2021 Gilbar ..... B65D 23/12
11,072,485 B2 * 7/2021 Spivey ..... B65D 81/3876
11,338,986 B2 * 5/2022 Leimone ..... B65D 13/02
11,465,745 B1 * 10/2022 Klaftenegger ..... B64D 1/08
11,478,094 B1 * 10/2022 Leimone ..... A47G 19/2288
11,673,734 B2 * 6/2023 Clarke ..... B65D 81/3874 220/592.17
2003/0052018 A1 * 3/2003 Wilson ..... A47G 19/22 206/217
2003/0155267 A1 * 8/2003 Mercier ..... B65D 21/022 206/515
2003/0173237 A1 * 9/2003 Kim ..... B65D 25/04 206/217
2004/0251157 A1 * 12/2004 Behnke ..... A47F 1/085 206/446
2005/0040068 A1 * 2/2005 Palder ..... B65D 1/22 206/499
2006/0102581 A1 * 5/2006 Yates, III ..... B65D 81/3216 215/6
2007/0289892 A1 * 12/2007 Hogerty ..... B65D 21/0233 206/515
2008/0017644 A1 * 1/2008 Wickland ..... G21F 5/12 250/506.1
2008/0202950 A1 * 8/2008 Anderson ..... B65D 51/2842 215/11.1
2009/0229472 A1 * 9/2009 Ferrara, Jr. ..... A47J 31/18 99/323
2009/0311389 A1 * 12/2009 Zoss ..... B65D 81/3211 206/219
2010/0320213 A1 * 12/2010 Kelly ..... A47J 41/0077 220/592.2
2011/0049169 A1 * 3/2011 Rosnak ..... B65D 51/1672 220/361
2011/0101005 A1 * 5/2011 Kelly ..... A47J 41/0077 220/660
2012/0298614 A1 * 11/2012 Nelson ..... B65D 51/24 215/308
2013/0037506 A1 * 2/2013 Wahlstrom ..... A61J 1/2093 215/6
2013/0119065 A1 * 5/2013 Buck ..... A47G 19/2205 220/523
2013/0126369 A1 * 5/2013 Gamelli ..... A47J 43/27 206/217
2014/0158699 A1 * 6/2014 Kim ..... A47G 19/2272 220/709
2014/0346169 A1 * 11/2014 Strominger ..... B65D 1/265 220/23.83
2015/0090711 A1 * 4/2015 Peterson ..... A61J 1/2096 220/4.07
2015/0282652 A1 * 10/2015 Honarvar ..... A61J 9/00 206/514
2015/0298867 A1 * 10/2015 Sanderson ..... A47G 19/2266 215/6
2015/0344178 A1 * 12/2015 Szymanksi ..... A47G 19/2205 206/514
2016/0114959 A1 * 4/2016 Strominger ..... B65D 21/0209 220/23.86
2016/0150902 A1 * 6/2016 Dokhanian ..... A47G 19/22 220/739
2016/0192797 A1 * 7/2016 Yang ..... B65D 53/02 220/592.17
2017/0021966 A1 * 1/2017 Parikh ..... B65D 43/021
2017/0113837 A1 * 4/2017 Szymanksi ..... B65D 21/0233
2017/0181556 A1 * 6/2017 Lai ..... A47G 21/18
2017/0251850 A1 * 9/2017 Coon ..... B65D 51/002
2017/0361984 A1 * 12/2017 Fouad ..... B65D 23/02
2018/0099805 A1 * 4/2018 Johnson ..... B65D 81/3205
2018/0184825 A1 * 7/2018 Lopynski ..... B65D 47/088
2018/0208389 A1 * 7/2018 Dowd ..... A47G 19/2261
2018/0368623 A1 * 12/2018 Cerasani ..... B65D 51/24
2020/0045986 A1 * 2/2020 Barr ..... B65D 77/24
2020/0172292 A1 * 6/2020 Serrahima ..... B65D 25/02
2020/0237126 A1 * 7/2020 Booska ..... A47G 19/2266
2021/0002028 A1 * 1/2021 Perry ..... B65D 43/0204
2021/0024261 A1 * 1/2021 Brown, II ..... A47G 19/2288
2021/0120987 A1 * 4/2021 Cheng ..... A47G 19/2266
2021/0171239 A1 * 6/2021 Gilbar ..... B65D 43/0229
2021/0386227 A1 * 12/2021 Fadden ..... A47G 19/2266
2022/0009697 A1 * 1/2022 Olmstead ..... B65D 47/06
2023/0146064 A1 * 5/2023 Cheng ..... A47G 19/2288 220/495.03
2025/0100759 A1 * 3/2025 Bradley ..... B65D 11/04
2025/0128856 A1 * 4/2025 Morris ..... B65D 21/0233

* cited by examiner

DUAL CONTAINER DRINKING VESSEL WITH UNIVERSAL LID

FIELD OF THE INVENTION

This disclosure generally relates to drinking vessels and, more specifically, to a drinking vessels with a lid.

BACKGROUND

Drinking vessels, such as cups, insulated beverage containers, canteens, and the like are used to contain fluids for drinking. These vessels come in many shapes and sizes. The shapes and sizes of such vessels often are dictated by the type of fluid contained, the amount of fluid desired to be contained, and/or the desired size/shape/weight of the container itself. For example, coffee typically is stored in smaller containers, whereas water typically is stored in larger containers. Other times the type of liquid is not as important as the size and weight of the container itself. In such instances, small containers typically are used when the user only desires to consume small amounts of liquid or desires a smaller/lighter container, whereas larger containers typically are used when the user desires to consume larger amounts of liquid or is not concerned with the size/weight of the container itself. As such, a single user may own a number of vessels in order to accommodate the particular use intended for a particular occasion. An object of the present invention is to provide a single vessel that can be converted to various uses so that a user need not own multiple vessels.

SUMMARY

The following presents a simplified summary of the invention in order to provide a basic understanding of some aspects of the invention. This summary is not an exhaustive overview of the invention. It is not intended to identify key or critical elements of the invention or to delineate the scope of the invention. Its sole purpose is to present some concepts in a simplified form as a prelude to the more detailed description that is discussed later.

Described herein are embodiments of an apparatus that include and/or consist of a dual container drinking vessel with a universal lid. In an embodiment, the apparatus includes a first vessel nested within a second vessel, where the same lid can be used to cover the first vessel (when the two vessels are nested) and to cover the second vessel (when the two vessels are not nested). Additional embodiments and details of the invention are described below in the drawings and detailed description. The actual scope and bounds of the invention are set forth in the appended claims.

BRIEF DESCRIPTION OF THE DRAWINGS

The disclosure may be understood by reference to the following description taken in conjunction with the accompanying drawings, in which like reference numerals identify like elements, and in which.

Figure 1:
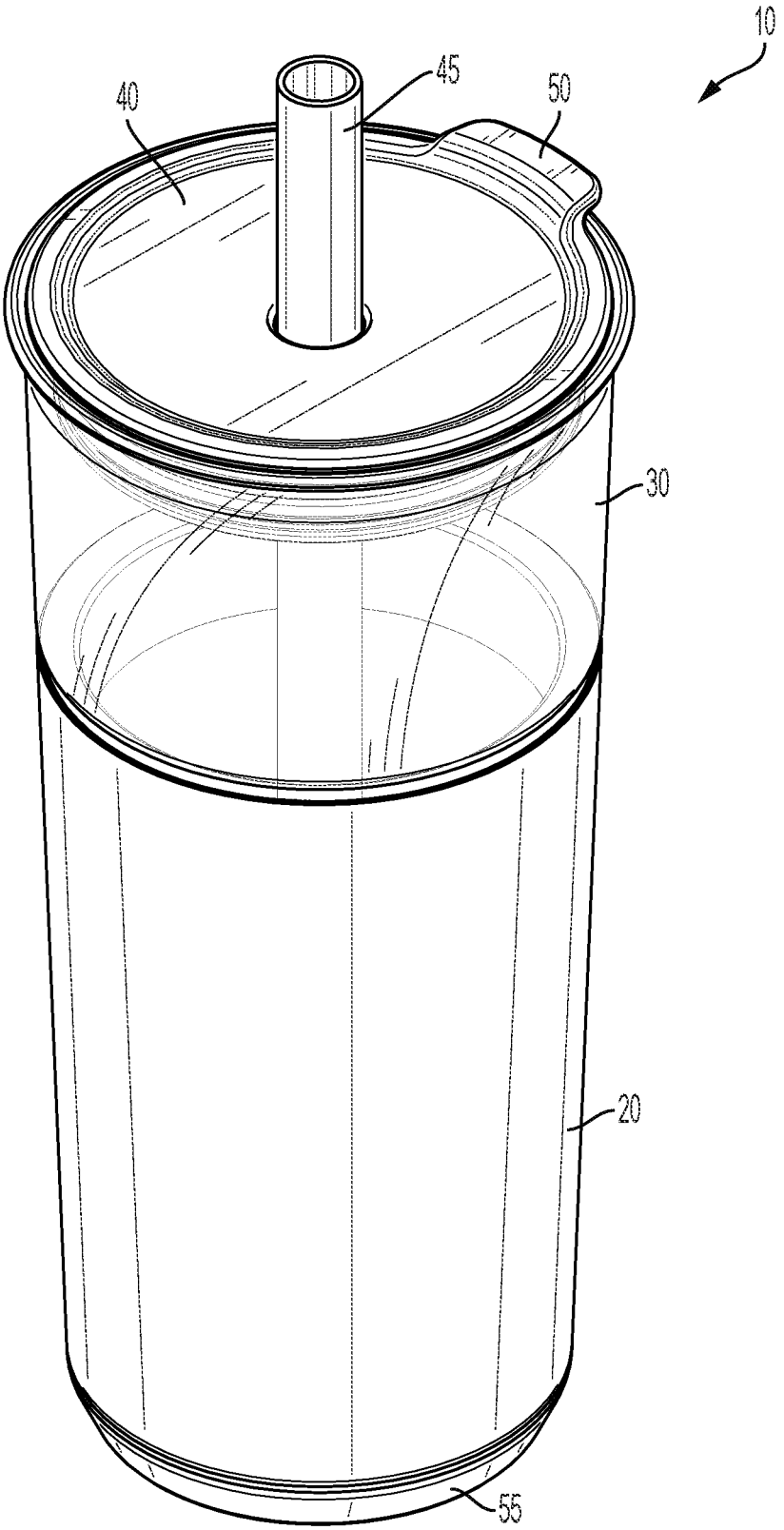
FIG. 1 is a front-side perspective view of one embodiment of a dual container drinking vessel with a universal lid.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the invention is to cover all modifications, equivalents, and alternatives falling within the spirit and scope of the invention as defined by the appended claims.

DETAILED DESCRIPTION

Various features and advantageous details are explained more fully with reference to the non-limiting embodiments that are illustrated in the accompanying drawings and detailed in the following description. Descriptions of well-known starting materials, processing techniques, components, and equipment are omitted so as not to unnecessarily obscure the invention. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

The present embodiments describe a dual container drinking vessel with a universal lid. FIG. 1 is a front-side perspective view of one embodiment of the drinking vessel and lid. As shown, the combination 10 includes lower vessel 20, upper vessel 30, and universal lid 40. The opening on upper vessel 30 is sized to receive lid 40 in a sealing arrangement that substantially prevents the contents of upper vessel 30 from inadvertently escaping/spilling. FIG. 1 also shows straw 45 extending through the top surface of lid 40 and into upper vessel Straw 45 is optional and those skilled in the art will appreciate that lid 40 could have one or more other drinking openings (in addition to, or to the exclusion of, the opening for straw 45) that allow a user to withdraw the contents of the upper vessel. FIG. 1 also shows optional lid lift member 50, which in this embodiment is located on the outer circumference of lid 40 so that a user can use it to more easily remove lid 40 from upper vessel 30 (or to separate upper vessel from lower vessel 20 as described in more detail below).

Still further, FIG. 1 shows several additional optional features of the present invention, such as a depressed surface of lid 40 (i.e., lid 40 includes a raised rim around at least a portion of its outer circumference) that traps inadvertently spilled liquids. Upper vessel 30 is illustrated as at least partially translucent, whereas lower vessel 20 is not. Any combination of translucent or opaque materials is within the scope of the present invention. Likewise, lower vessel 20 and/or upper vessel 30 can be made from any suitable material, including vacuum-sealed layers to preserve the temperature of the vessel's contents. Finally, combination 10 is illustrated as having optional beveled bottom 55.

Figure 2:
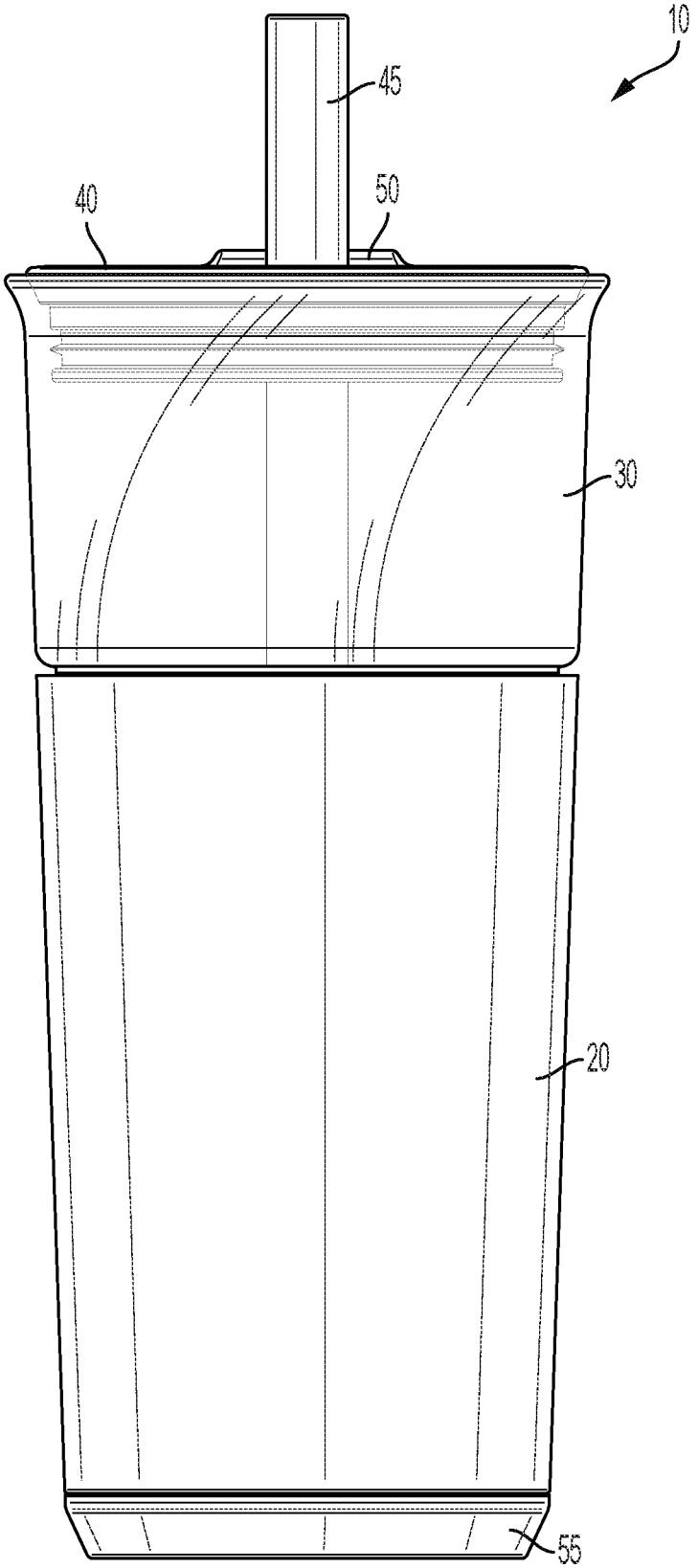
FIG. 2 is a back view of one embodiment of a dual container drinking vessel with a universal lid.
Figure 3:
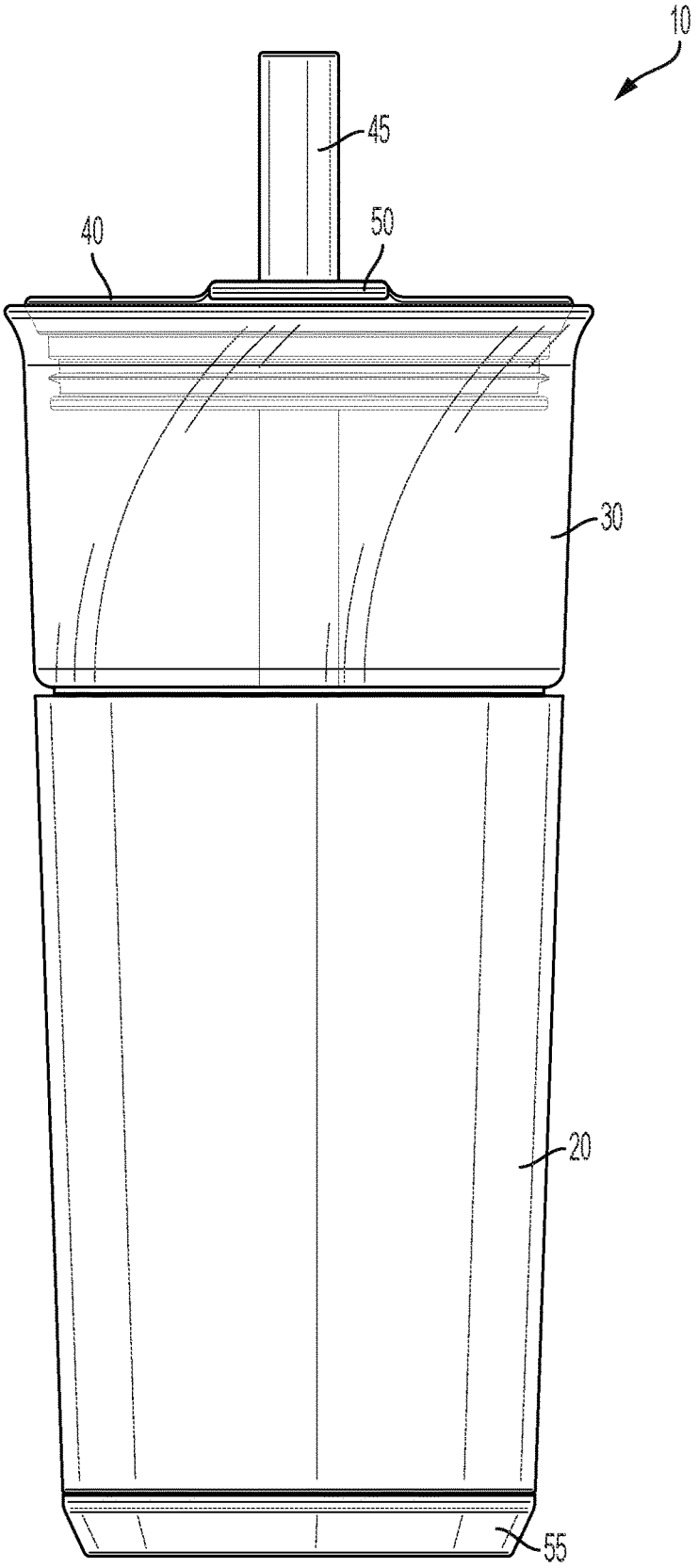
FIG. 3 is a front view of one embodiment of a dual container drinking vessel with a universal lid.
Figure 4:
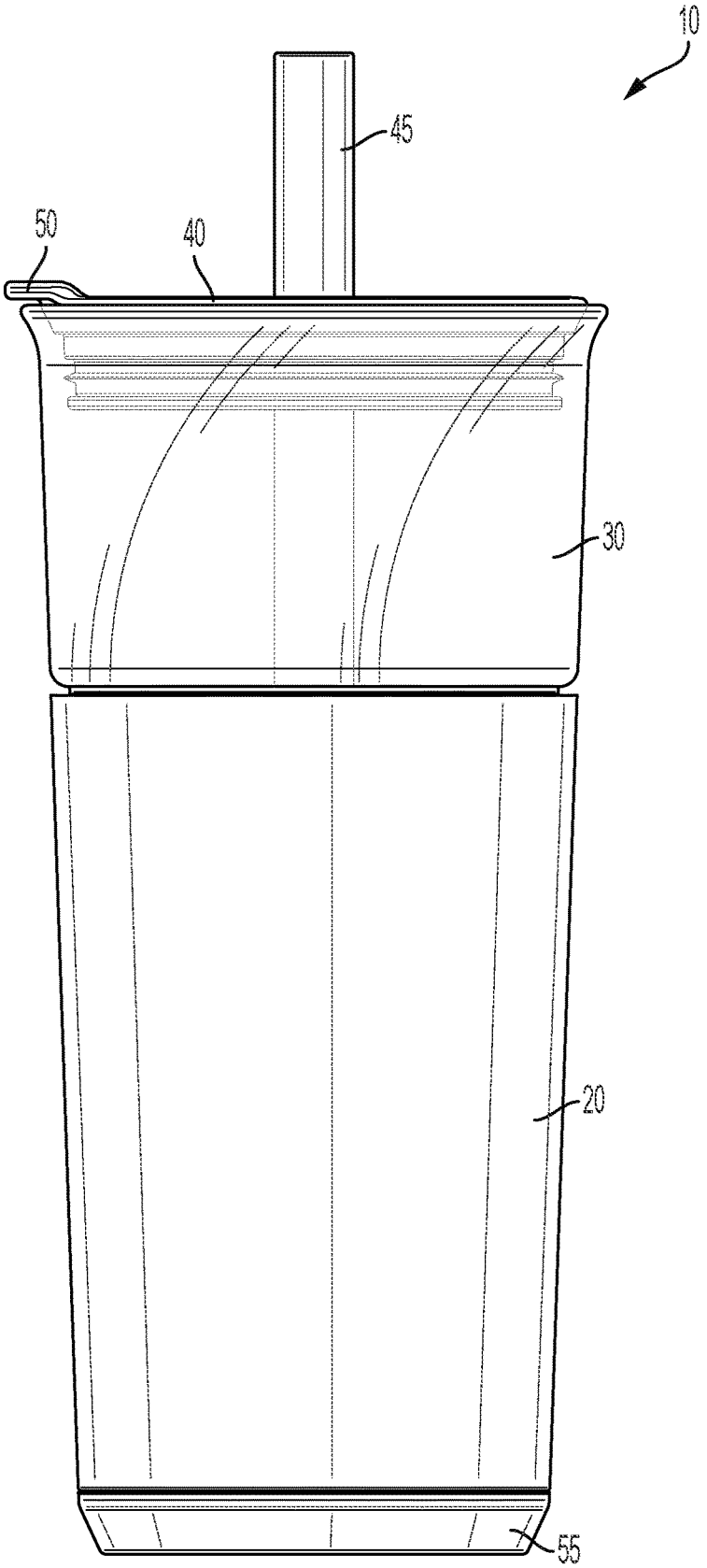
FIG. 4 is a left side view of one embodiment of a dual container drinking vessel with a universal lid.
Figure 5:
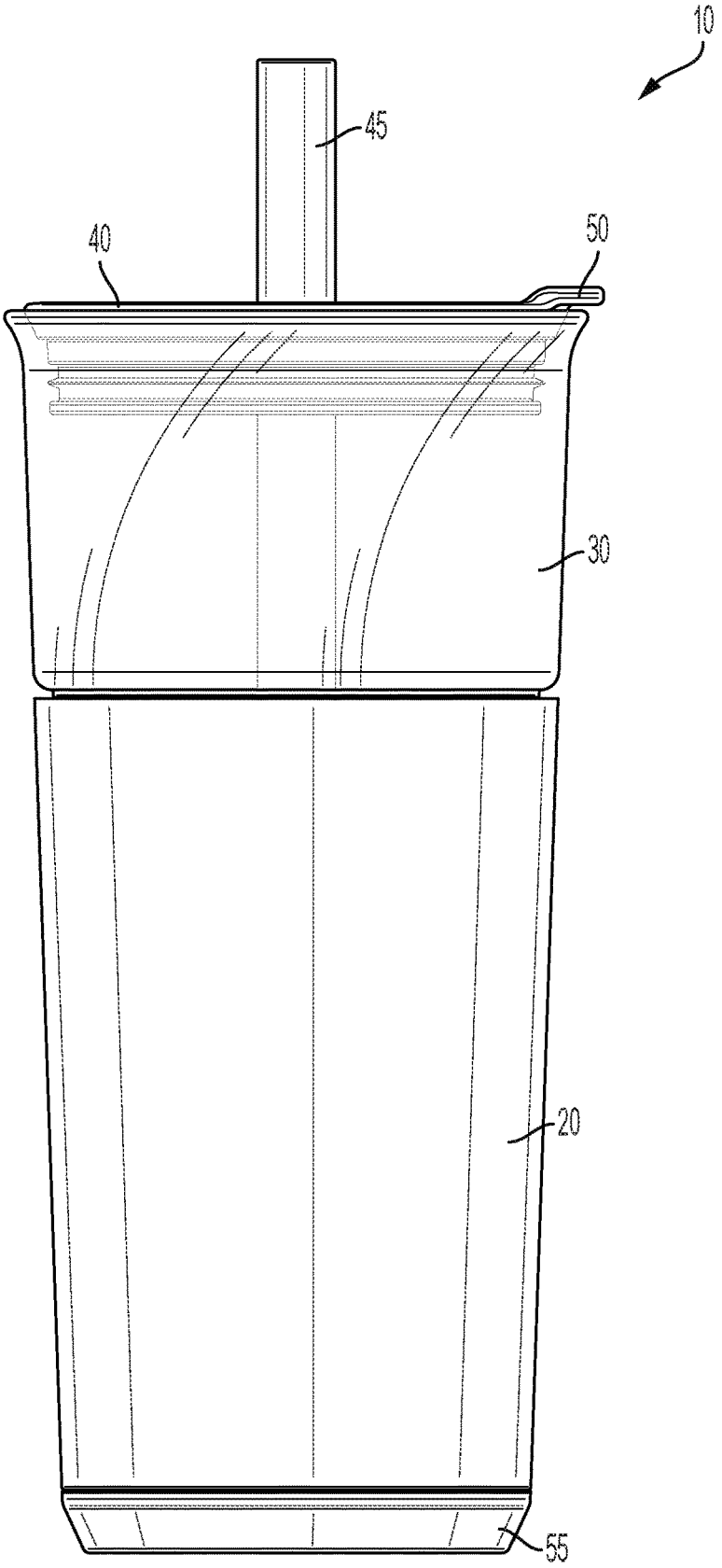
FIG. 5 is a right side view of one embodiment of a dual container drinking vessel with a universal lid.
Figure 6:
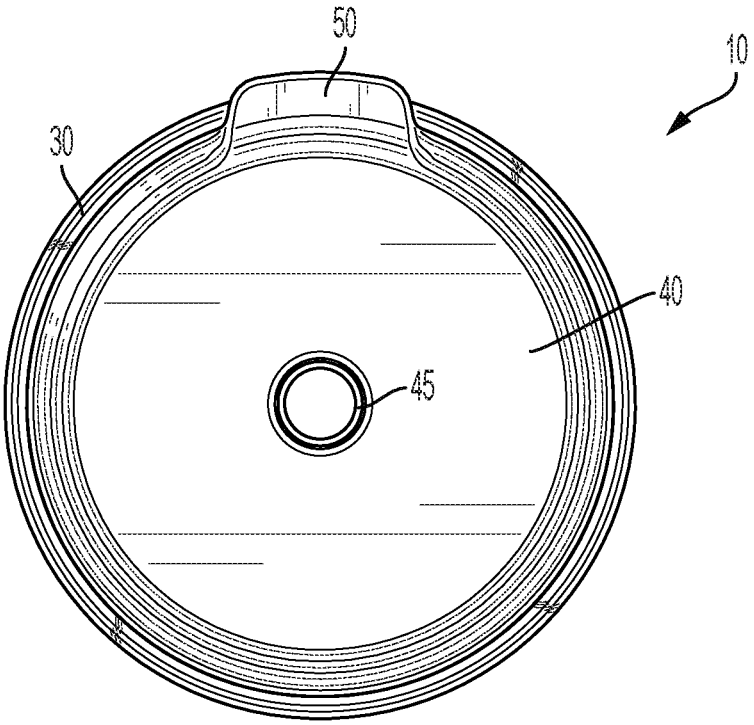
FIG. 6 is a top view of one embodiment of a dual container drinking vessel with a universal lid.
Figure 7:
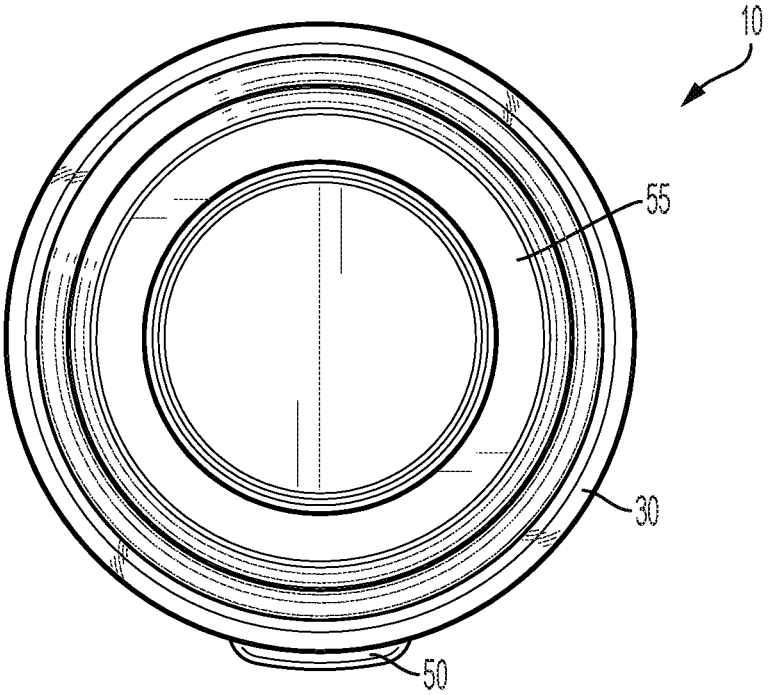
FIG. 7 is a bottom view of one embodiment of a dual container drinking vessel with a universal lid.

FIG. 2 is a back view of one embodiment of a dual container drinking vessel with a universal lid. Like FIG. 1, FIG. 2 shows combination 10 as including (in this particular embodiment) lower vessel 20, upper vessel 30, universal lid 40, straw 45, lid lift 50, and beveled bottom 55. FIG. 3 is a front view of this embodiment. FIG. 4 is a left side view of this embodiment. FIG. 5 is a right side view of this embodiment. FIG. 6 is a top view of this embodiment. FIG. 7 is a bottom view of this embodiment.

As noted by FIG. 6, lid 40 is sized to fit within the inside diameter of the upper portion of upper vessel 30. Other embodiments are possible, such as a lid 40 that fits over (or around) the outside diameter of the upper portion of upper vessel 30. FIG. 7 also better illustrates that in this particular embodiment, lid lift 50 is sized so that it extends beyond the largest outside diameter of any other portion of combination 10, although other sizes of lid lift 50 are possible. Those skilled in the art will appreciate the additional leverage afforded by different sizes/configurations of lid lift 50.

Figure 8:
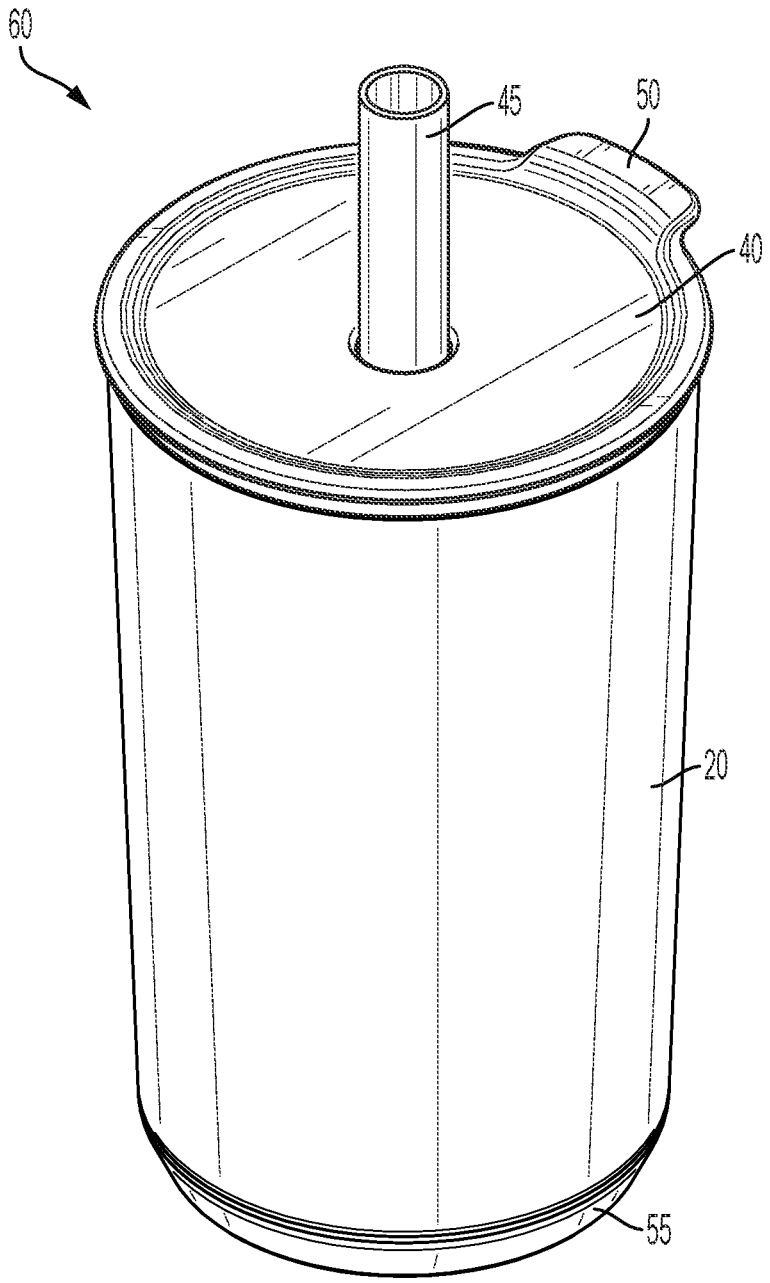
FIG. 8 is a front-side perspective view of one embodiment of a lower portion of a dual container drinking vessel with a universal lid.

FIG. 8 is a front-side perspective view of one embodiment of a lower portion of a dual container drinking vessel with a universal lid. As shown, combination 60 includes lower vessel 20 and universal lid 40. Lower vessel 20 and universal lid 40 are the same as lower vessel and universal lid 40 shown in FIGS. 1-7. Specifically, as shown in more detail below, lower vessel 20 and upper vessel 30 can be separated from one another, and the opening on lower vessel 20 is sized to receive lid 40 in a sealing arrangement that substantially prevents the contents of lower vessel 20 from inadvertently escaping/spilling. Thus, lid 40 can be used to cover upper vessel 30 when upper vessel 30 and lower vessel 20 are combined (or nested together), and lid 40 can be used to cover lower vessel 20 when lower vessel 20 has been separated from upper vessel 30.

FIG. 8 also shows straw 45 extending through the top surface of lid 40 and into lower vessel 20. As before, straw 45 is optional and those skilled in the art will appreciate that lid 40 could have one or more other drinking openings (in addition to or to the exclusion of the opening for straw 45) that allow a user to withdraw the contents of the lower vessel. FIG. 8 also shows optional lid lift member 50, which in this embodiment is located on the outer circumference of lid 40 so that a user can use it to more easily remove lid 40 from lower vessel 20.

Figure 9:
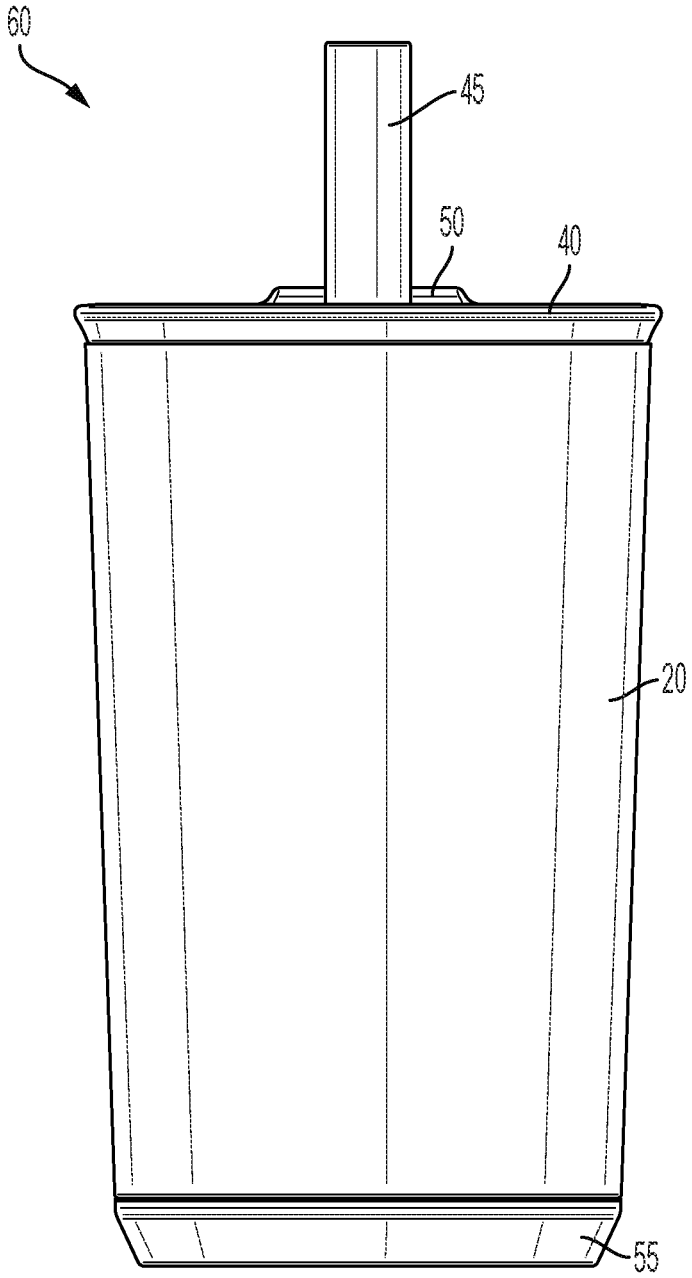
FIG. 9 is a back view of one embodiment of a lower portion of a dual container drinking vessel with a universal lid.
Figure 10:
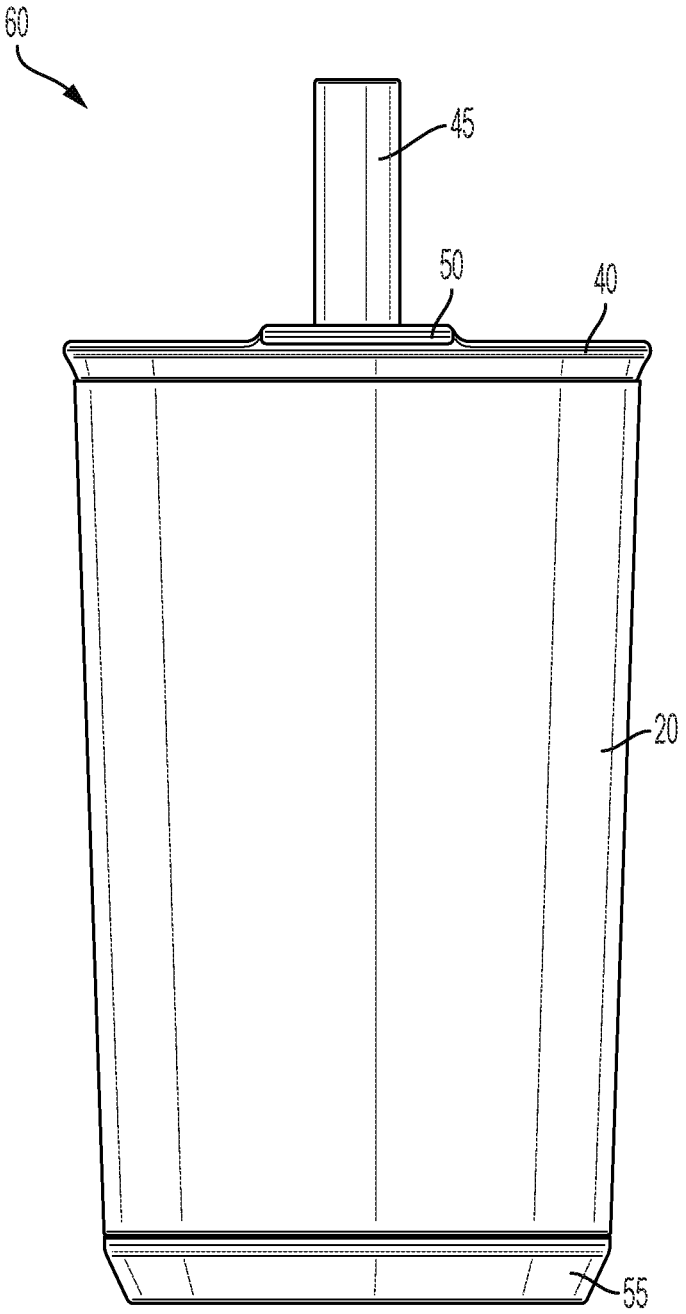
FIG. 10 is a front view of one embodiment of a lower portion of a dual container drinking vessel with a universal lid.
Figure 11:
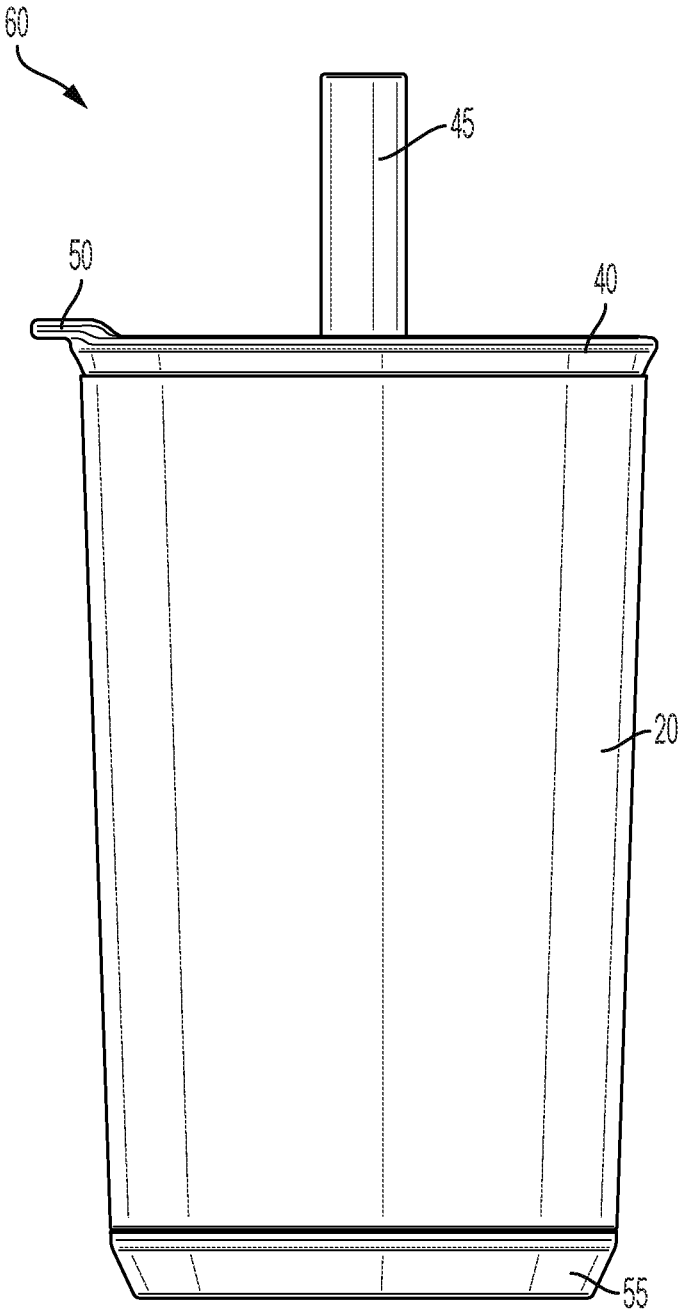
FIG. 11 is a left side view of one embodiment of a lower portion of a dual container drinking vessel with a universal lid.
Figure 12:
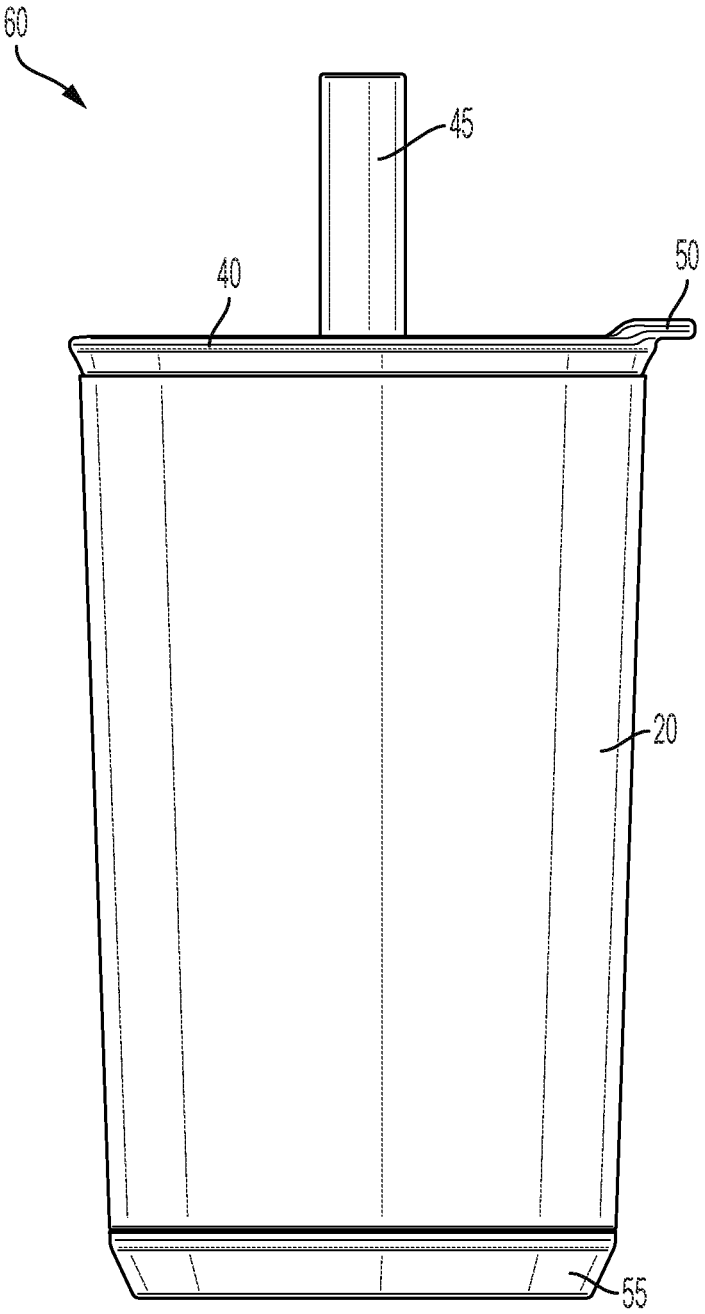
FIG. 12 is a right side view of one embodiment of a lower portion of a dual container drinking vessel with a universal lid.
Figure 13:
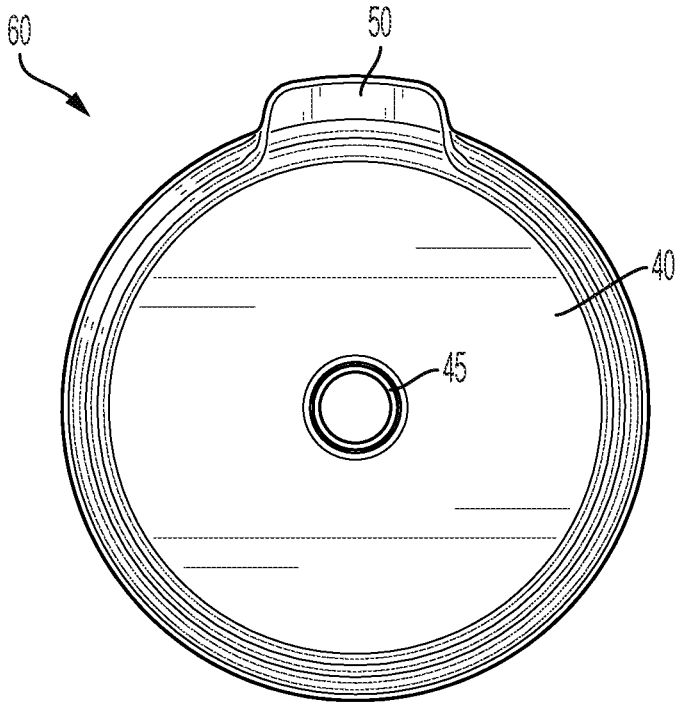
FIG. 13 is a top view of one embodiment of a lower portion of a dual container drinking vessel with a universal lid.
Figure 14:
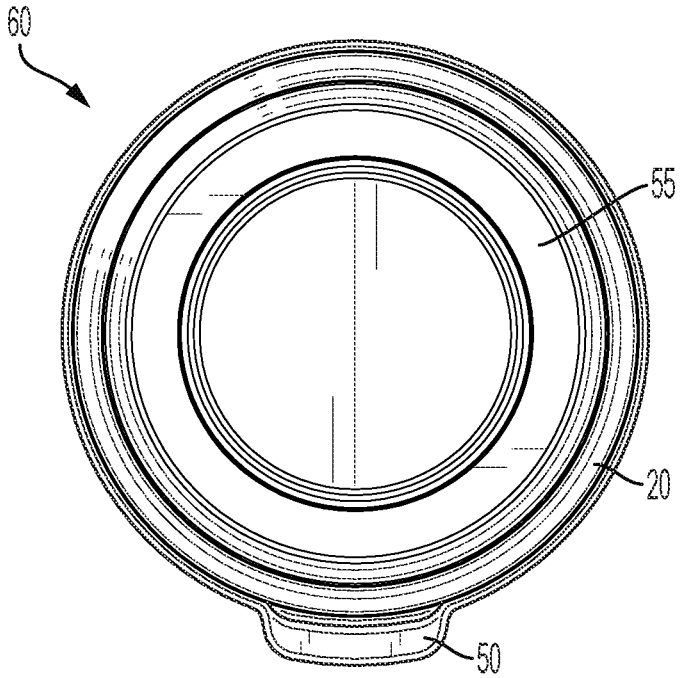
FIG. 14 is a bottom view of one embodiment of a lower portion of a dual container drinking vessel with a universal lid.

FIG. 9 is a back view of the embodiment shown in FIG. 8. Like FIG. 8, FIG. 9 shows combination 60 as including (in this particular embodiment) lower vessel 20, universal lid 40, straw 45, lid lift 50, and beveled bottom 55. FIG. 10 is a front view of this embodiment. FIG. 11 is a left side view of this embodiment. FIG. 12 is a right side view of this embodiment. FIG. 13 is a top view of this embodiment. FIG. 14 is a bottom view of this embodiment. As noted by FIGS. 9-12, lid 40 is sized to fit within the inside diameter of the upper portion of lower vessel 20. Other embodiments are possible, such as a lid 40 that fits over (or around) the outside diameter of the upper portion of lower vessel 20. The only limitation is that lid 40 must fit the opening of upper vessel 30 and the opening of lower vessel 20, thereby making it a "universal" lid. FIGS. 13-14 also better illustrate that in this particular embodiment, lid lift 50 is sized so that it extends beyond the largest outside diameter of any other portion of combination 60, although other sizes of lid lift 50 are possible. Those skilled in the art will appreciate the additional leverage afforded by different sizes/configurations of lid lift 50.

Figure 15:
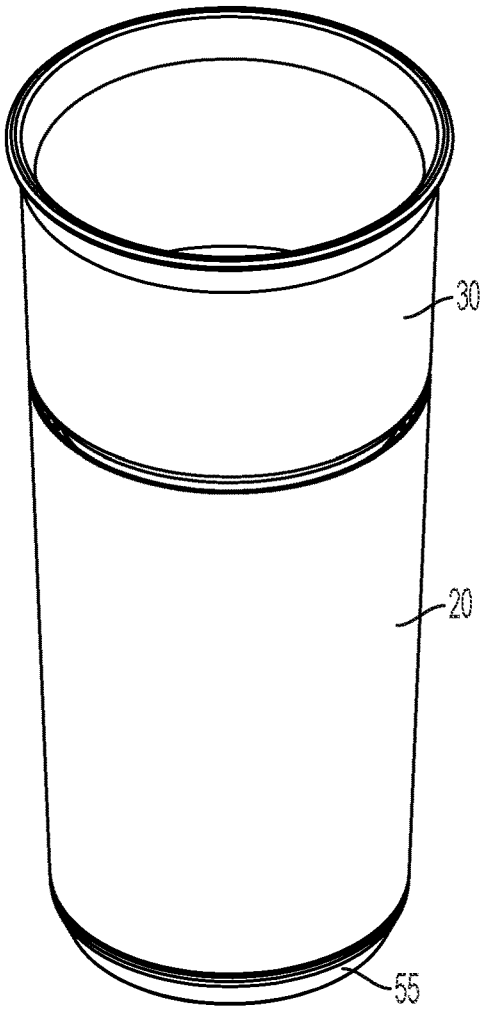
FIG. 15 is a front-side perspective view of one embodiment of a dual container drinking vessel.
Figure 16:
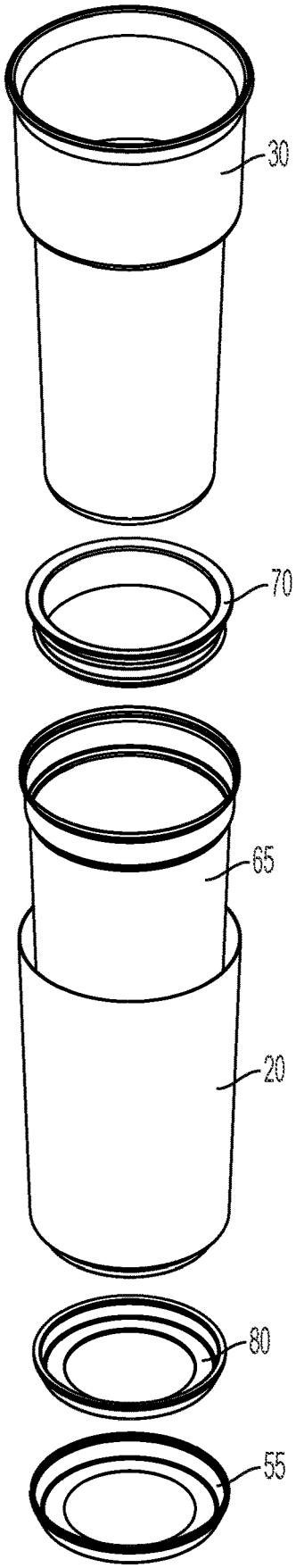
FIG. 16 is an assembly view of one embodiment of a dual container drinking vessel.

FIG. 15 is a front-side perspective view of one embodiment of a dual container drinking vessel. As before, lower vessel 20, upper vessel 30, and beveled bottom 55 are visible. FIG. 16 is an assembly view of one embodiment of a dual container drinking vessel. As shown, this embodiment of the assembly may include lower vessel 20, upper vessel 30, and beveled bottom 55. Also shown for this particular embodiment is insulated lower insert 65. The combination of lower vessel 20 and insulated lower insert 65 may form a vacuum insulated combination as further illustrated at least in FIG. 18. Coupled to the bottom of lower vessel 20 is footing 80, which can be coupled by any number of techniques known in the art. Beveled bottom 55, shown in this embodiment as a separate component, is then affixed to the underside of footing 80 by any number of techniques known in the art.

Finally, FIG. 16 illustrates fastener 70, which can be attached (permanently or removably) to either the combination of lower vessel 20 and insulated lower insert 65, or to upper vessel 30. Fastener 70 has an inside diameter sized to snuggly receive the outside diameter of at least the lower portion of upper vessel 30 so that the two vessels (lower vessel 20 and upper vessel 30) snuggly nest together to form a combination such as that shown in FIGS. 1-5 and 15. In other embodiments, fastener 70 is not present, but the inside diameter of lower vessel 20 (including or not including insulated lower insert 65) is sized relative to the outside diameter of at least the lower portion of upper vessel 30 so that the two vessels (lower vessel 20 and upper vessel 30) snuggly nest together to form a combination such as that shown in FIGS. 1-5 and 15. The snug relationship between lower vessel 20 and upper vessel 30 is such that the two vessels generally will remain nested unless a modicum of force is applied by a user (or otherwise) to separate them.

Figure 18:
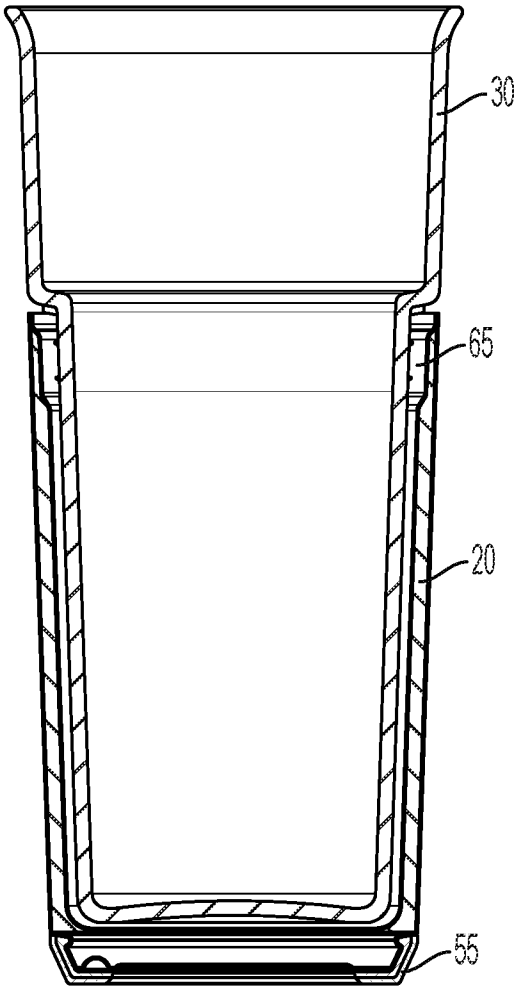
FIG. 18 is a cross-section taken along cross-section line 18-18 in FIG. 17.
Figure 17:
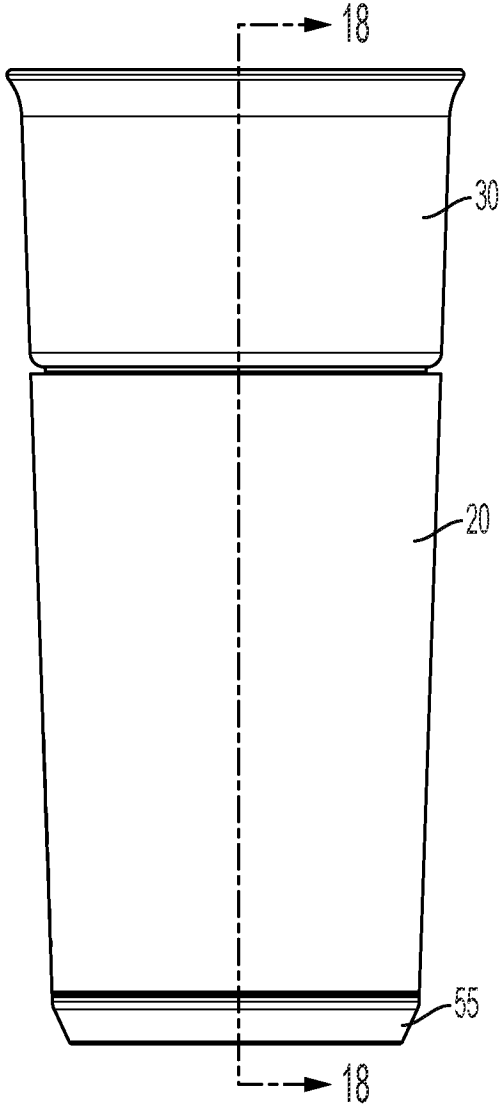
FIG. 17 is a front view of one embodiment of a dual container drinking vessel, including cross-section line 18-18.

FIG. 17 is a front view of one embodiment of a dual container drinking vessel, including cross-section line 18-18. Like FIG. 15, this embodiment illustrates lower vessel 20 nested together with upper vessel 30. FIG. 18 is a cross-section taken along cross-section line 18-18 in FIG. 17. FIG. 18 better illustrates the nested relationship between lower vessel 20 and upper vessel 30. Specifically, the outer sidewall of lower vessel 20 is visible in FIG. 18 and, moving inwardly (toward the inside of the vessel), are the sidewall of insulated lower insert and then the sidewall of upper vessel 30. In this particular embodiment, the nesting of the lower vessel and the upper vessel is complete such that the bottom of upper vessel 30 rests substantially near the bottom of lower vessel 20. Other nesting embodiments are possible. For example, the bottom of upper vessel 30 need not extend all the way to the bottom of lower vessel nor do the sidewalls of upper vessel 30 necessarily need to extend substantially to the sidewalls of lower vessel 20.

Figure 20:
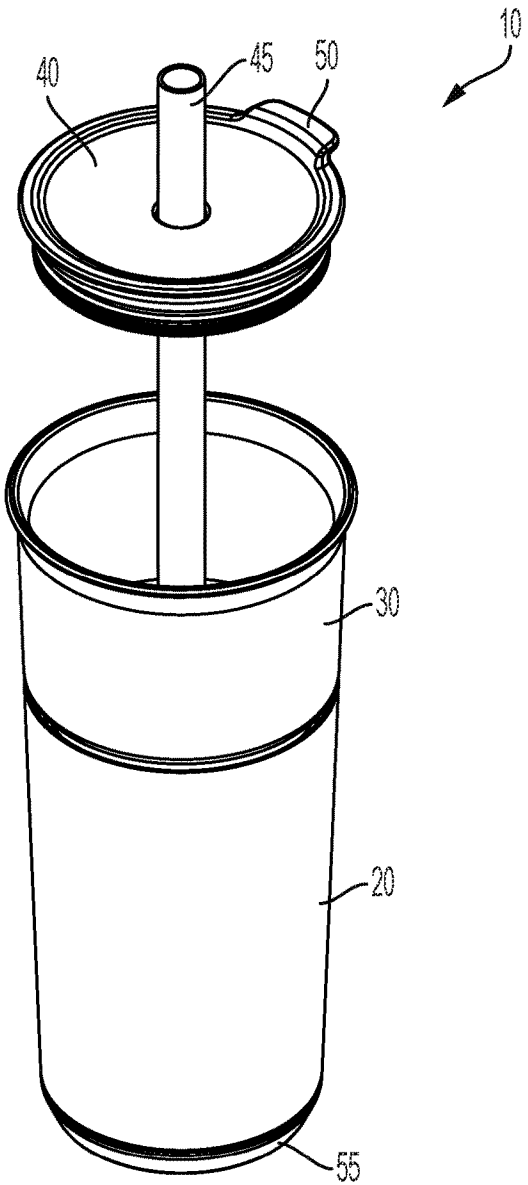
FIG. 20 is an exploded, front side perspective view of one embodiment of a dual container drinking vessel with a universal lid.
Figure 19:
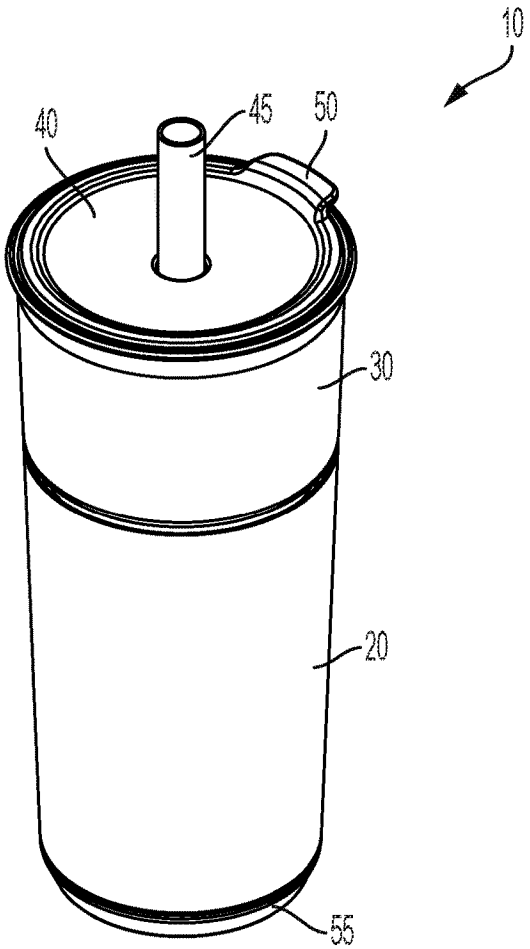
FIG. 19 is a front-side perspective view of one embodiment of a dual container drinking vessel with a universal lid.

FIG. 19 is a front-side perspective view of one embodiment of a dual container drinking vessel with a universal lid. Like FIG. 1, FIG. 19 illustrates combination 10 as including lower vessel 20, upper vessel 30, and universal lid 40. FIG. 20 is an exploded, front side perspective view of one embodiment of a dual container drinking vessel with a universal lid. FIG. 20 better illustrates the removable relationship between universal lid 40 and upper vessel 30. Specifically, while the opening on upper vessel 30 is sized to receive lid 40 in a sealing arrangement that substantially prevents the contents of upper vessel 30 from inadvertently escaping/spilling, the lid can be attached to the upper vessel by any number of known techniques, such as via threads, seals, and/or a snap-on connection.

Figure 22:
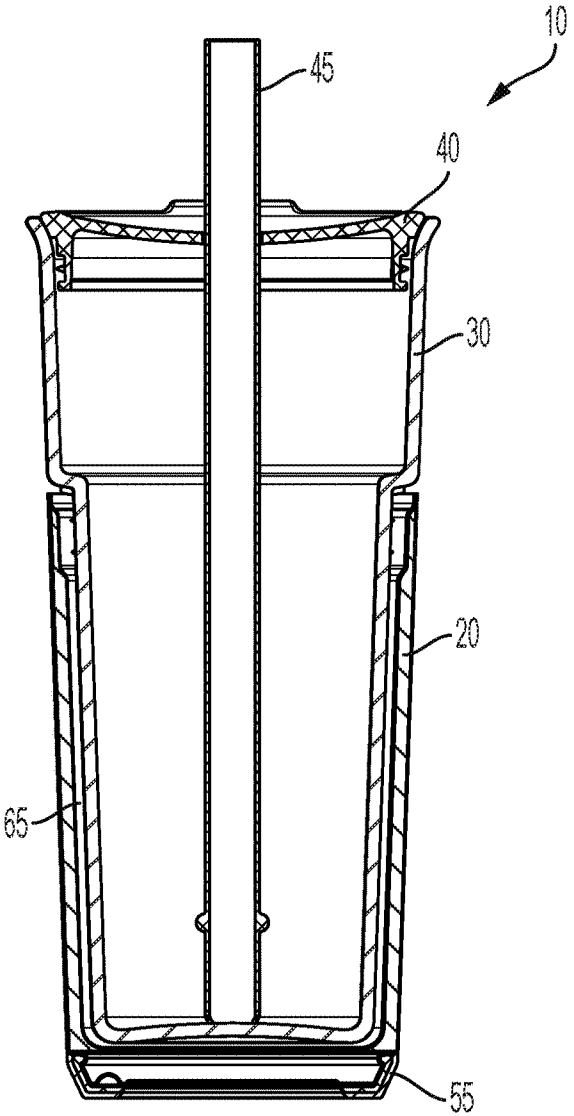
FIG. 22 is a cross-section taken along cross-section line 22-22 in FIG. 21.
Figure 21:
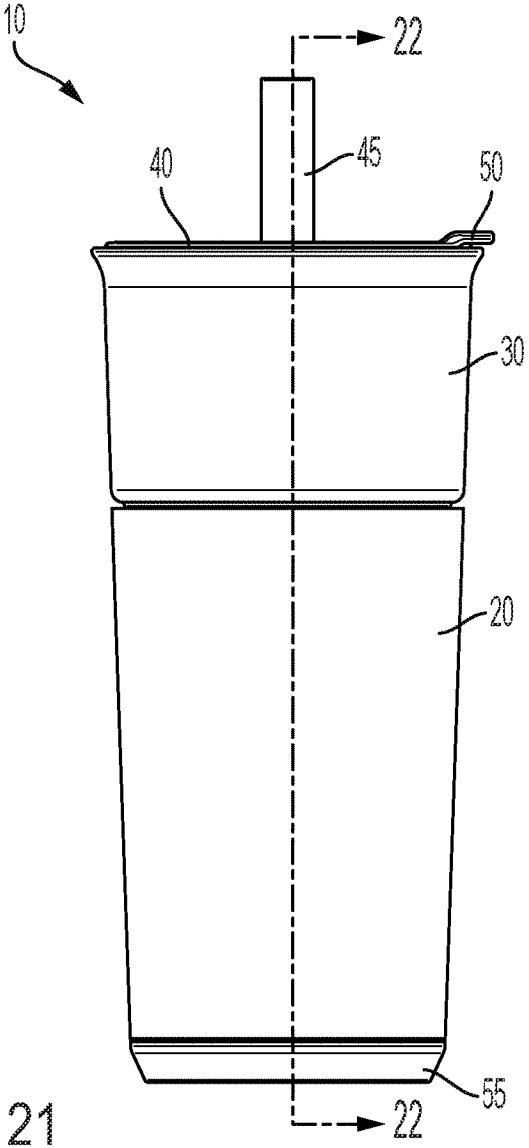
FIG. 21 is a right side view of one embodiment of a dual container drinking vessel with a universal lid, including cross-section line 22-22.

FIG. 21 is a right side view of one embodiment of a dual container drinking vessel with a universal lid, including cross-section line 22-22. Like FIG. 15, this embodiment illustrates lower vessel 20 nested together with upper vessel 30. FIG. 22 is a cross-section taken along cross-section line 22-22 in FIG. 21. FIG. 22 better illustrates the nested relationship between lower vessel 20 and upper vessel 30. Specifically, the outer sidewall of lower vessel 20 is visible in FIG. 22 and, moving inwardly (toward the inside of the vessel), are the sidewall of insulated lower insert 65 and then the sidewall of upper vessel 30. In this particular embodiment, the nesting of the lower vessel and the upper vessel is substantially complete in that the bottom of upper vessel 30 rests substantially at the bottom of lower vessel Other nesting embodiments are possible. For example, the bottom of upper vessel 30 need not extend all the way to the bottom of lower vessel 20, nor do the sidewalls of upper vessel 30 necessarily need to extend all the way to the sidewalls of lower vessel 20. Also shown in FIG. 21 (unlike that of FIG. 18) is the integration of universal lid 40 with the opening of upper vessel 30, further including straw 45 extending therethrough and into upper vessel 30.

Figure 23:
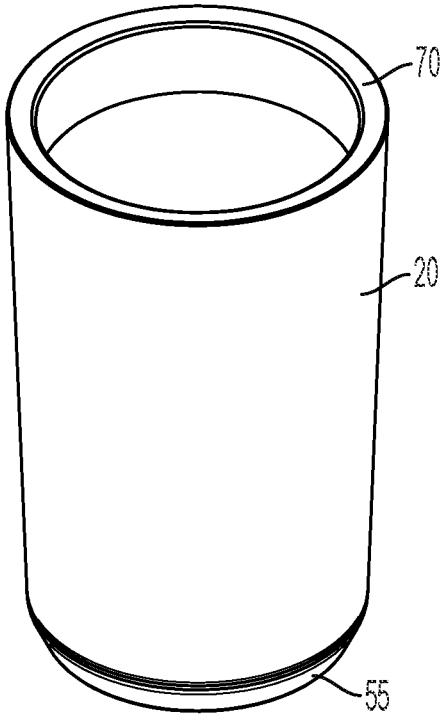
FIG. 23 is a front-side perspective view of one embodiment of a lower vessel of a dual container drinking vessel.
Figure 24:
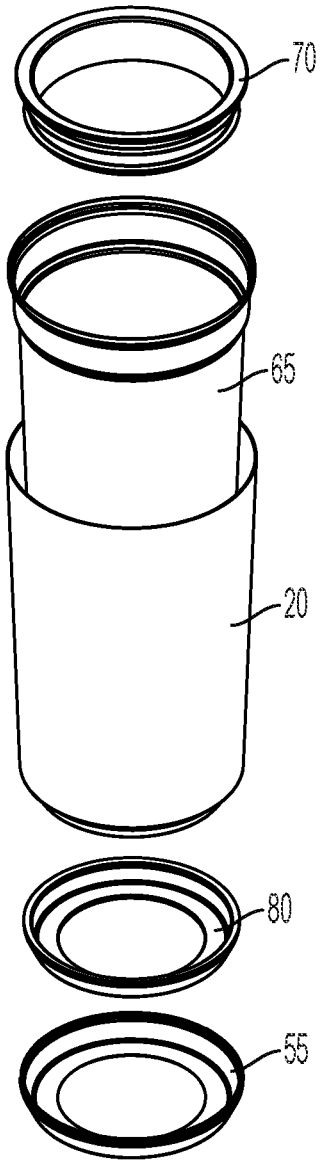
FIG. 24 is an assembly view of one embodiment of a lower vessel of a dual container drinking vessel.

FIG. 23 is a front-side perspective view of one embodiment of a lower vessel of a dual container drinking vessel. As before, lower vessel 20, beveled bottom 55, and fastener 70 are visible. FIG. 24 is an assembly view of one embodiment of a lower vessel of a dual container drinking vessel. As shown, this embodiment of the assembly may include lower vessel 20 and beveled bottom 55. Also shown for this particular embodiment is insulated lower insert 65. The combination of lower vessel 20 and insulated lower insert 65 may form a vacuum insulated combination. Coupled to the bottom of lower vessel 20 is footing 80, which can be coupled by any number of techniques known in the art. Beveled bottom 55, here shown in this embodiment as a separate component, is then affixed to the underside of footing 80 by any number of techniques known in the art.

FIG. 24 also illustrates fastener 70, which can be attached (permanently or removably) to either the combination of lower vessel 20 and insulated lower insert 65, or to upper vessel 30 (not shown). Fastener 70 preferably has an inside diameter sized to snuggly receive the outside diameter of at least the lower portion of upper vessel 30 (not shown) so that the two vessels (lower vessel 20 and upper vessel 30) snuggly nest together to form a combination such as that shown in FIGS. 1-5, 15, and 17-22. In other embodiments, fastener 70 is not present, but the inside diameter of lower vessel 20 (including or not including insulated lower insert 65) is sized relative to the outside diameter of at least the lower portion of upper vessel 30 so that the two vessels (lower vessel 20 and upper vessel 30) snuggly nest together to form a combination such as that shown in FIGS. 1-5, 15, and 17-22. The snug relationship between lower vessel 20 and upper vessel 30 is such that the two vessels generally will remain nested unless a modicum of force is applied by a user (or otherwise) to separate them.

Figure 26:
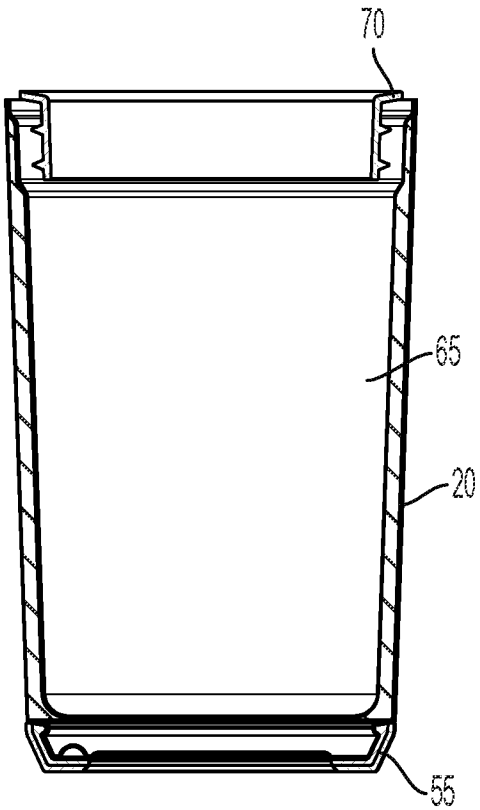
FIG. 26 is a cross-section taken along cross-section line 26-26 in FIG. 25.
Figure 25:
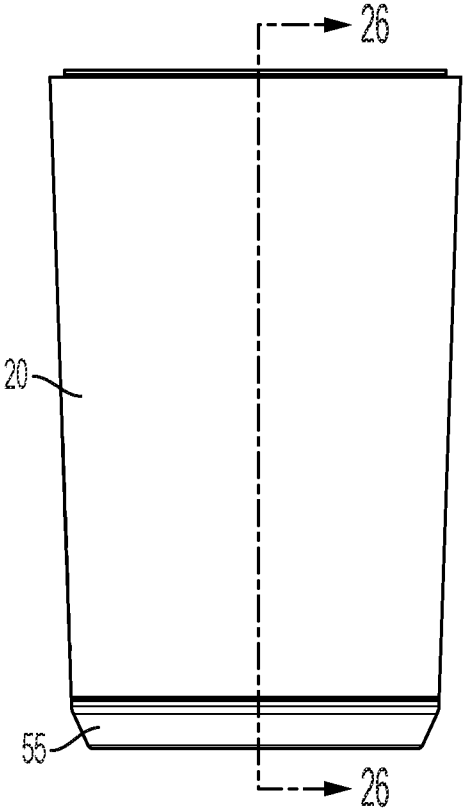
FIG. 25 is a front view of one embodiment of a lower vessel of a dual container drinking vessel, including cross-section line 26-26.

FIG. 25 is a front view of one embodiment of a lower vessel of a dual container drinking vessel, including cross-section line 26-26. FIG. 26 is a cross-section taken along cross-section line 26-26 in FIG. 25. FIG. 26 better illustrates the sidewall layers of this particular embodiment. Specifically, FIG. 26 illustrates the outer sidewall of lower vessel 20 and, moving inwardly (toward the inside of the vessel), is the sidewall of insulated lower insert 65. The gap between the sidewalls may be vacuum insulated. FIG. 26 also shows fastener 70 mounted in the upper end of lower vessel 20. The gap between the sidewall of fastener 70 and the sidewall of insulated lower insert 65 (or the sidewall of lower vessel 20 if insulated lower insert 65 is not present) may also be vacuum sealed.

Figure 28:
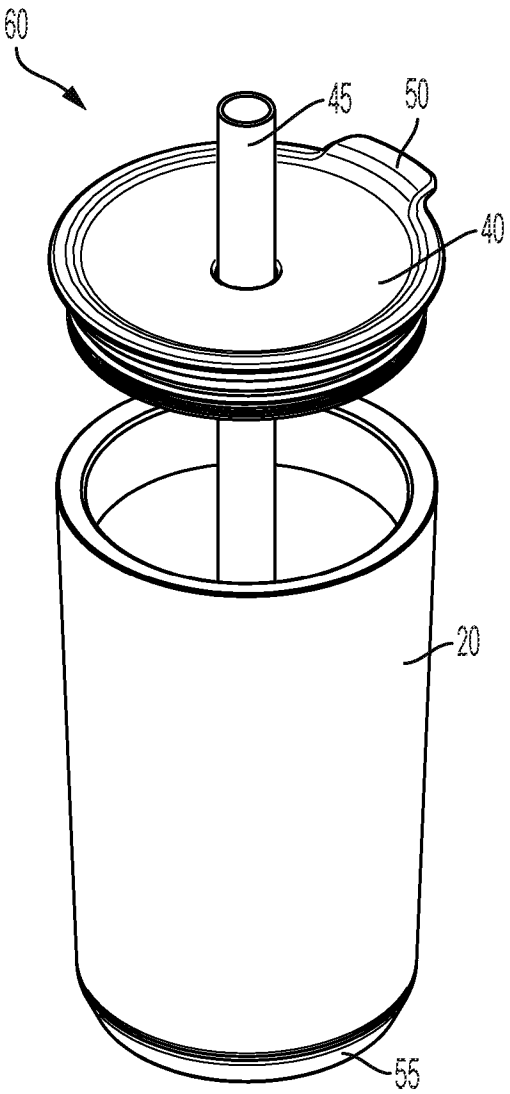
FIG. 28 is an exploded, front side perspective view of one embodiment of a lower vessel of a dual container drinking vessel with a universal lid.
Figure 27:
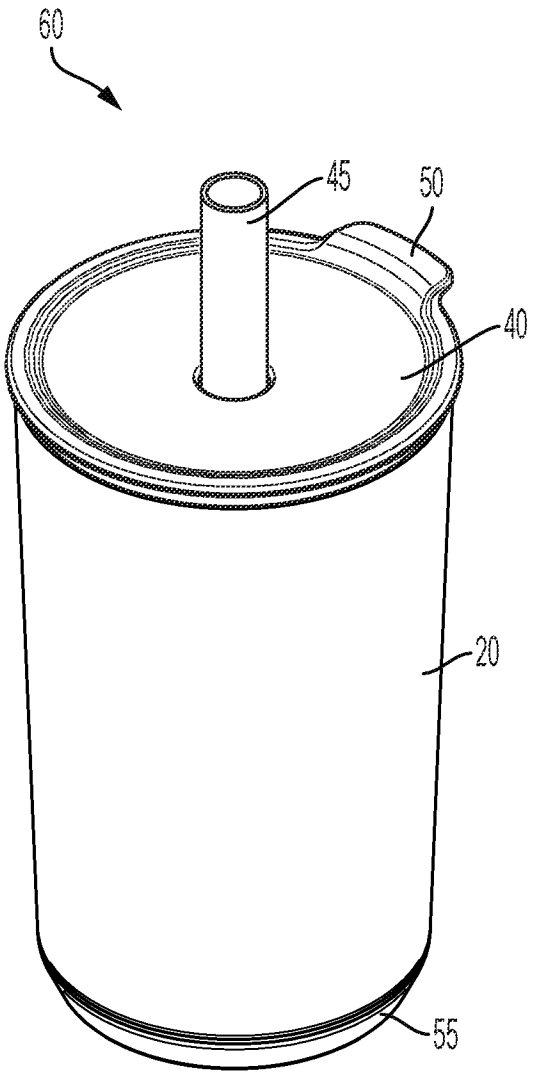
FIG. 27 is a front-side perspective view of one embodiment of a lower vessel of a dual container drinking vessel with a universal lid.

FIG. 27 is a front-side perspective view of one embodiment of a lower vessel of a dual container drinking vessel with a universal lid. Like FIG. 8, FIG. 27 illustrates combination 60 as including lower vessel 20 and universal lid 40. FIG. 28 is an exploded, front side perspective view of one embodiment of a lower vessel of a dual container drinking vessel with a universal lid. FIG. 28 better illustrates the removable relationship between universal lid 40 and lower vessel 20. Specifically, while the opening on lower vessel 20 is sized to receive lid 40 in a sealing arrangement that substantially prevents the contents of lower vessel from inadvertently escaping/spilling, the lid can be attached to the lower vessel by any number of known techniques, such as via threads, seals, and/or a snap-on connection. Importantly, the lid 40 that seals lower vessel 20 is the same lid 40 that seals upper vessel 30. In other words, the lid is interchangeable for use on upper vessel 30 and on lower vessel 20. In this manner, lid 40 can be used to cover upper vessel 30 when upper vessel 30 is nested with lower vessel 20, and likewise lid 40 can be used to cover lower vessel 20 when upper vessel 30 is not nested with lower vessel 20. In this manner, lid 40 can be used on two vessels of varying sizes, which can be useful when a user desires use of a smaller or larger vessel, or even a vessel that is more insulated than another (such as would be the case for upper vessel 30 when it is nested in lower vessel 20).

Figure 30:
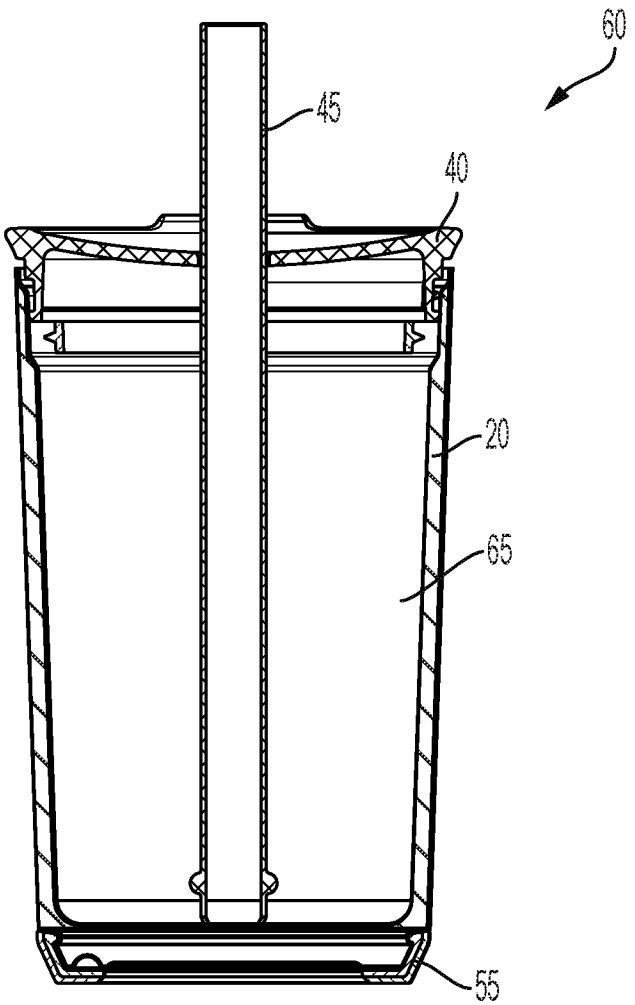
FIG. 30 is a cross-section taken along cross-section line 30-30 in FIG. 29.
Figure 29:
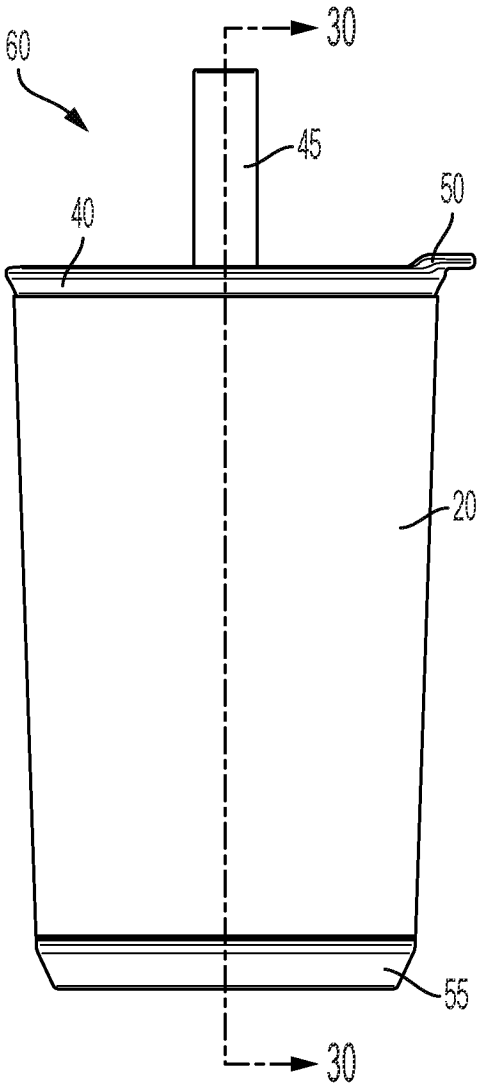
FIG. 29 is a right side view of one embodiment of a lower vessel of a dual container drinking vessel with a universal lid, including cross-section line 30-30.

FIG. 29 is a right side view of one embodiment of a lower vessel of a dual container drinking vessel with a universal lid, including cross-section line 30-30. FIG. 30 is a cross-section taken along cross-section line 30-30 in FIG. 29. FIG. 30 better illustrates the outer sidewall of lower vessel 20 and, moving inwardly (toward the inside of the vessel), is the sidewall of insulated lower insert 65. Also shown in FIG. 30 is the integration of universal lid with the opening of lower vessel 20, further including straw 45 extending therethrough and into lower vessel 20.

Although the invention(s) is/are described herein with reference to specific embodiments, various modifications and changes can be made without departing from the scope of the present invention(s), as set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

Accordingly, the protection sought herein is as set forth in the claims below.

The invention claimed is:

1. A drinking container, comprising:

a first vessel and a second vessel, where the first vessel is shaped to contain a liquid and optionally nest with the second vessel;

the second vessel shaped to contain a liquid when it is not nested with the first vessel and substantially incapable of containing a liquid when it is nested with the first vessel;

a fully removable lid for attaching only to the first vessel and for covering an open end of the first vessel, but not an open end of the second vessel, when the first vessel and the second vessel are nested together, and for covering the open end of the second vessel when the first vessel and the second vessel are not nested together.

2. The drinking container of claim 1 wherein the second vessel provides insulation to the first vessel when the first vessel and the second vessel are nested together.

3. The drinking container of claim 2 wherein the fully removable lid includes a drinking opening.

4. The drinking container of claim 3 wherein the drinking opening includes a straw.

5. The drinking container of claim 4 wherein the straw is adapted to withdraw liquid contained in the first vessel but not the second vessel when the first vessel and the second vessel are nested together.

6. The drinking container of claim 5 wherein the straw is adapted to withdraw liquid contained in the second vessel when the first vessel and the second vessel are not nested together.

7. The drinking container of claim 6 wherein the lid includes a lift adapted to assist in removing the lid from either the first vessel or the second vessel.

8. The drinking container of claim 7 wherein the first vessel includes a first outside diameter and the second vessel includes a second outside diameter, wherein the lift extends beyond the outside diameter of the first vessel and beyond the outside diameter of the second vessel.

9. The drinking container of claim 8 wherein the lid has a third outside diameter where the third outside diameter is smaller than the first or second outside diameter.

10. The drinking container of claim 9 wherein the second vessel is vacuum-sealed.

11. The drinking container of claim 10 wherein the first vessel is vacuum-sealed.

12. The drinking container of claim 1 further comprising a drinking opening in the fully removable lid for drinking from the first vessel but not the second vessel when the first vessel and the second vessel are nested together.

13. The drinking container of claim 12 wherein the first vessel covers the open end of the second vessel when the first vessel and the second vessel are nested together.

14. The drinking container of claim 13 wherein the fully removable lid includes an attachment means for attaching to the open end of the first vessel when the first vessel and the second vessel are nested together and for attaching to the open end of the second vessel when the first vessel and the second vessel are not nested together.

15. A drinking container, comprising:

a first vessel adapted to contain a liquid;

a second vessel adapted to contain a liquid, where the second vessel is separate from the first vessel, and where the first vessel and the second vessel are at least partially nested together;

a fully removable lid attaching only to the first vessel and covering an open end of the first vessel, but not an open end of the second vessel, when the first vessel and the second vessel are at least partially nested together, and covering the open end of the second vessel when the first vessel and the second vessel are not nested together, wherein the fully removable lid includes a drinking opening and a straw in the drinking opening.

16. The drinking container of claim 15 wherein the second vessel provides insulation to the first vessel when the first vessel and the second vessel are at least partially nested together.

17. The drinking container of claim 16 wherein the straw is adapted to withdraw liquid contained in the first vessel but not the second vessel when the first vessel and the second vessel are at least partially nested together.

18. The drinking container of claim 17 wherein the straw is adapted to withdraw liquid contained in the second vessel when the first vessel and the second vessel are not nested together.

19. The drinking container of claim 18 wherein the lid includes a lift adapted to assist in removing the lid from either the first vessel or the second vessel.

20. The drinking container of claim 19 wherein the first vessel includes a first outside diameter and the second vessel includes a second outside diameter, wherein the lift extends beyond the outside diameter of the first vessel and beyond the outside diameter of the second vessel.

21. The drinking container of claim 20 wherein the lid has a third outside diameter, where the third outside diameter is smaller than the first or second outside diameter.

22. The drinking container of claim 21 wherein the second vessel is vacuum-sealed.

23. The drinking container of claim 22 wherein the first vessel is vacuum-sealed.

24. The drinking container of claim 23 wherein the first vessel covers the open end of the second vessel when the first vessel and the second vessel are at least partially nested together.

25. The drinking container of claim 24 wherein the fully removable lid includes an attachment means for attaching to the open end of the first vessel when the first vessel and the second vessel are at least partially nested together and for attaching to the open end of the second vessel when the first vessel and the second vessel are not nested together.

26. The drinking container of claim 1 wherein the fully removable lid has a height, and the open end of the first vessel is displaced above the open end of the second vessel by more than the height of the fully removable lid.

* * * * *